United States Patent [19]

Choksi et al.

[11] 3,950,917

[45] Apr. 20, 1976

[54] METHOD OF OPENING A DOUBLE SCREW CAP SYSTEM FOR STERILE MEDICAL CONTAINER

[75] Inventors: Pradip V. Choksi, North Hollywood; Roy B. Steidley, Seal Beach, both of Calif.

[73] Assignee: American Hospital Supply Corporation, Evanston, Ill.

[22] Filed: Sept. 15, 1975

[21] Appl. No.: 613,321

Related U.S. Application Data

[62] Division of Ser. No. 338,671, March 7, 1973, Pat. No. 3,923,184.

[52] U.S. Cl. ..... 53/3; 53/14; 53/381 A

[51] Int. Cl.[2] ..... B65B 43/00

[58] Field of Search ..... 53/3, 381 R, 381 A, 53/14; 215/1 C, 32, 215, 9, 303, DIG. 3; 220/265

[56] References Cited

UNITED STATES PATENTS

| | | | |
|---|---|---|---|
| 2,940,229 | 6/1960 | Baker | 53/3 |
| 3,419,172 | 12/1968 | Lee | 215/32 |
| 3,664,536 | 5/1972 | Emery | 215/251 |
| 3,795,337 | 3/1974 | Nozawa et al. | 215/9 |

*Primary Examiner*—Travis S. McGehee
*Assistant Examiner*—John Sipos
*Attorney, Agent, or Firm*—Robert T. Merrick; Larry N. Barger

[57] ABSTRACT

A sterile medical liquid container system that includes an inner cap and an outer cap nested together and having interconnecting splines. The inner cap has internal right-handed threads and is screwed onto a threaded bottle neck to hermetically seal this neck. The outer cap has external left-handed threads and is fused at a frangible joint to the thermoplastic bottle. A jacking ring with internal left-handed threads screws onto the outer cap and a continuous clockwise motion of the jacking ring acts to (1) fracture the outer cap, and (2) unscrew the combined intersplined inner and outer caps from the container neck.

6 Claims, 8 Drawing Figures

FIG. 5.
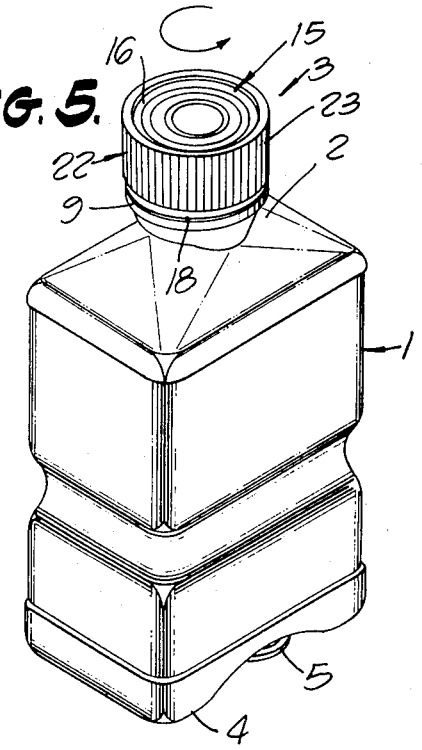
FIG. 6.
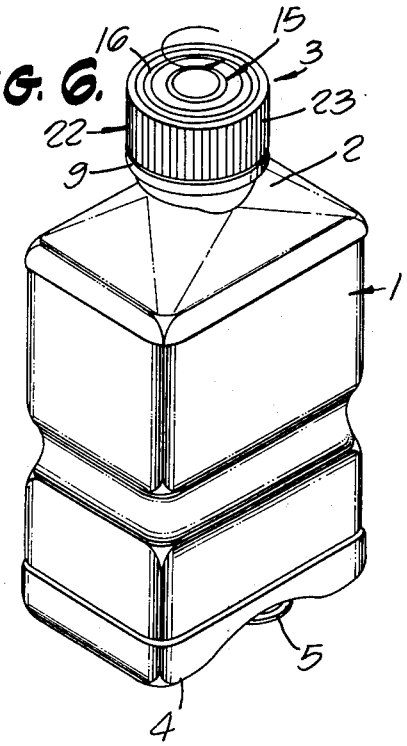
FIG. 7.
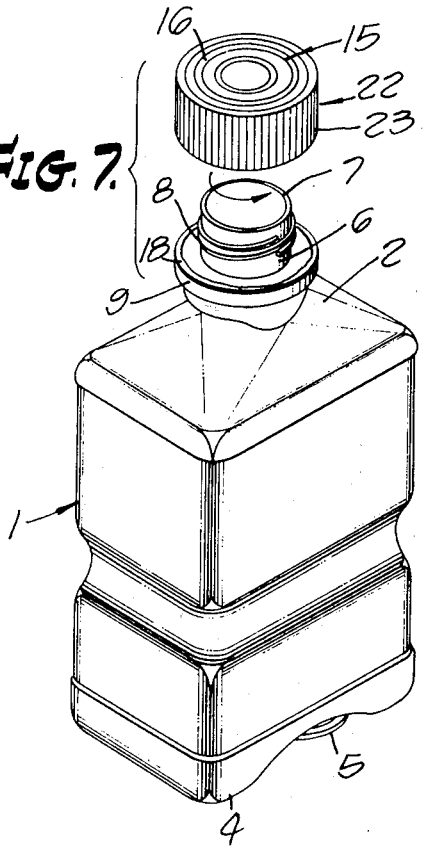
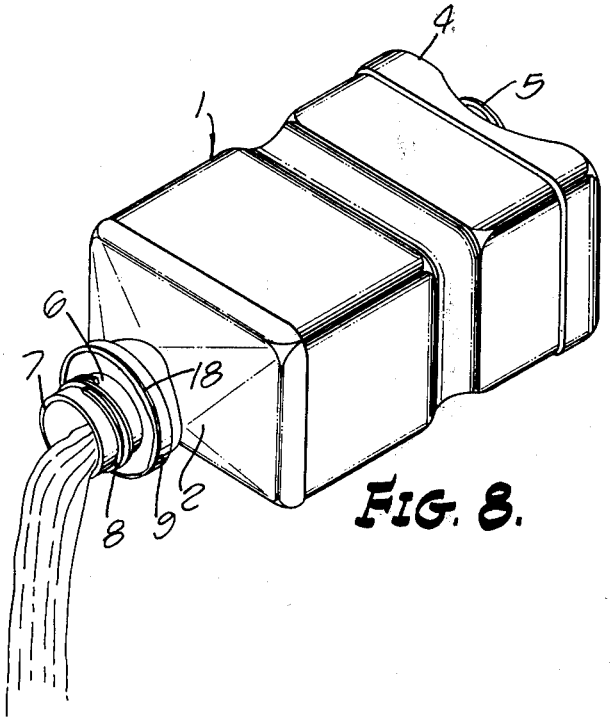
FIG. 8.

METHOD OF OPENING A DOUBLE SCREW CAP SYSTEM FOR STERILE MEDICAL CONTAINER

This is a division, of application Serial No. 338,671 filed Mar. 7, 1973 now U.S. Pat. No. 3,923,184.

BACKGROUND

There have been various types of closure systems for sterile medical liquid containers. Many of these closure systems included an inner cap and an outer cap that form double sterility protector seals. In most cases the outer cap was removed as a separate step prior to opening the inner cap. In some medical circumstances this procedure may be desired. Examples might include opening the outer closure prior to connecting an administration set to the inner closure.

However, there are certain circumstances where it is desired to simultaneously remove the inner and outer closures as quickly and easily as possible. An example would be where a container with a double closure system has a measured volume of liquid that is to be poured into another container. Here the entire liquid contents of the first container would be dispensed at once. Another example would be where a physician desires to dispense a measured quantity of liquid into a surgical wound or the like. Thus, a physician can completely empty a ½ liter bottle of liquid into the wound and have a much more accurate volume record than he could by pouring out ¼ of the liquid contents from a 2 liter container.

With previous containers having double closure systems the nurse or physician often had to go through an intricate tedious series of steps to open the container. This problem was aggravated when numerous bottles had to be opened for a particular medical procedure.

SUMMARY OF THE INVENTION

This invention provides a simple easy to open double closure system on a thermoplastic bottle for sterile medical liquids. A single counterclockwise unscrewing motion of the cap performs a sequence of opening steps. The double cap structure of this invention includes an inner cap with internal right-handed threads, and an outer cap with external left-handed threads. The outer cap fits over the inner cap and has a bottom end of the outer cap skirt sealed to the thermoplastic bottle. To prevent relative rotation, the inner and outer caps have skirts that are longitudinally splined together. During opening of this closure a jacking ring with internal left-handed threads is screwed onto the outer cap. Counterclockwise motion of this jacking ring first breaks apart the outer cap and then wedges tightly onto this outer cap. Continued clockwise rotation of the jacking ring simultaneously removes the interlocked inner and outer caps. The jacking ring and both caps are lifted from the bottle neck as a unit. To a nurse or physician opening the container, it appears that he is simply unscrewing a cap and pouring the contents in a simple easy motion.

THE DRAWINGS

FIGS. 5 to 8 illustrate the various steps in opening the special double cap system of this invention.

DETAILED DESCRIPTION

Figure 1:
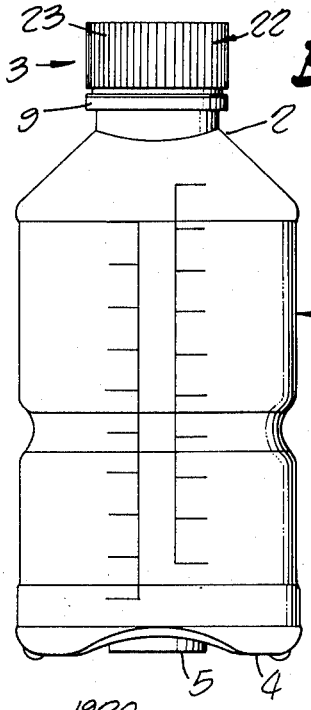
FIG. 1 is a front elevational view of the bottle and closure system as it is stored prior to opening.

With reference to FIG. 1, the container is shown as a thermoplastic blow-molded bottle 1 that has an upper end portion 2 to which is attached the closure system, indicated generally as 3. At a lower end of the bottle is a base 4 and a hinged hanging tab 5. This hanging tab is for suspending the bottle in a mouth downward position if desired.

Figure 2:
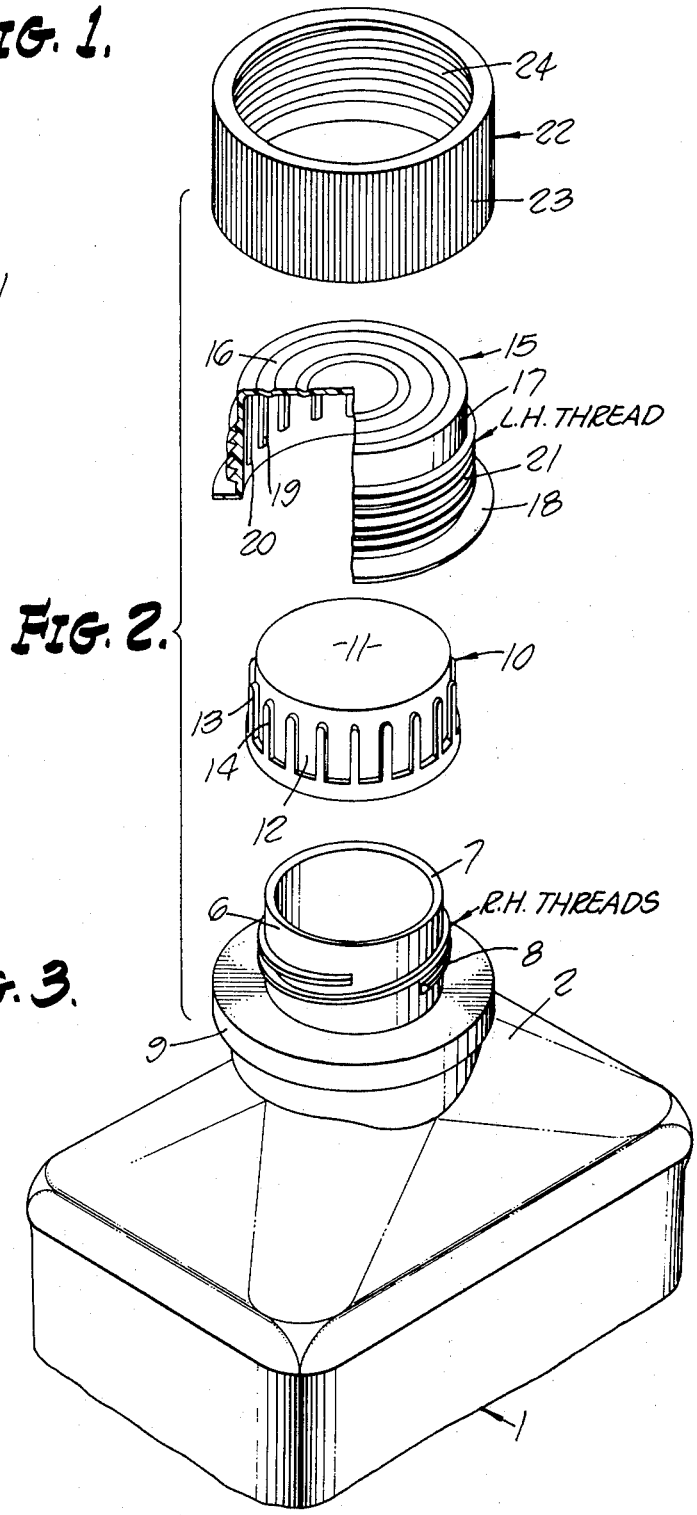
FIG. 2 is an exploded perspective view of the bottle and three elements of the closure system.

The various elements of the bottle and closure system are shown in more detail in FIG. 2. Here the top portion 2 of the bottle has a dispensing neck 6 that terminates in an outer pouring lip 7. Neck 6 has external threads 8 that are "right-handed." The term "right-handed" means that the cap screws downwardly on these threads with a clockwise rotational motion. At a base of neck 6 is an external thermoplastic flange 9.

Fitting onto this neck 6 is an inner cap 10. Inner cap 10 is internally threaded with right-handed threads which mesh with external threads 8 of the neck 6. Inner cap 10 includes a top wall 11 and a downwardly extending annular skirt 12. Extending longitudinally along an exterior surface of this skirt 12 are a series of ribs 13 and 14. The importance of these ribs will be mentioned later in their relationship to an outer cap.

A thermoplastic outer cap 15 fits over the inner cap and includes a top wall 16 and an annular downwardly extending skirt 17. At a lower end of skirt 17 is a thin thermoplastic frangible brim 18 integral with the inner cap. When the outer cap is assembled over the inner cap the frangible brim 18 is heat fused at an annular hermetic seal to flange 9. Thus, there is a double hermetic seal made by the closure system. The inner cap 10 hermetically seals against pouring lip 7 and the frangible brim 18 is hermetically sealed at an annular heat fusion joint with the flange 9.

Two important features of the outer cap are shown in FIG. 2. The first structural feature includes a series of internal logitudinal ribs 19 and 20 on an internal surface of skirt 17. These ribs 19 and 20 interfit between ribs 13 and 14 of the inner cap 10. Thus the inner and outer caps can move longitudinally but cannot rotationally move relative to each other. This inter-relationship is called an "intersplining" of the inner and outer caps. This "intersplining" can also be created by forming the ribs as small longitudinal serrations on only the inner cap or outer cap, and then diametrically shrinking the outer cap onto the inner cap to impress these serrations on the other cap. Such shrinking can be done by forming the outer cap with more internal stress than the inner cap and then stress relieving the two caps with steam sterilization. Such stress relief is explained in detail in an application by Elmer F. St. Amand and Thomas R. Thornbury entitled "Threaded Closure System For Medical Liquid Container and Method of Making Same" filed as Ser. No. 338,684 on Mar. 7, 1973, now U.S. Pat. No. 3,923,062.

Combined with this intersplining is an important thread feature of the outer cap. The threads 21 on an outer surface of skirt 17 of the outer cap are "left-handed" and threads 8 on an inner surface of the inner cap are "right-handed". Thus the inner and outer caps can be considered a double screw closure system.

Figure 3:
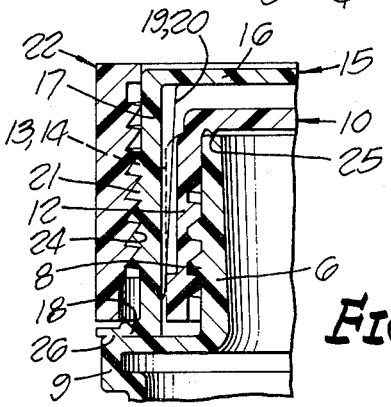
FIG. 3 is an enlarged sectional view through a left side portion of the closure system, with both inner and outer cap seals intact.

The top element shown in FIG. 3 is a rigid jacking ring 22. This jacking ring has a knurled or grooved outer surface 23 for easy gripping. An internal surface has left-handed threads 24 that interfit and mesh with the threads 21 of the outer cap.

When the bottle neck, inner cap, outer cap and jacking ring are all assembled after the bottle has been filled with its liquid contents and sterilized, it appears as in FIG. 3. Here the top wall 11 of cap 10 forms a first annular hermetic seal at 25 with the pouring lip 7 of the bottle neck. The outer cap forms the second annular hermetic seal at 26 at its annular fusion joint with the flange 9. The inter connecting rib 19 fits against a rib of the inner cap 10 to stop relative rotation of the inner and outer caps.

As previously mentioned, the container with closure system is shipped to the hospital as shown in FIG. 3. When it is desired to open the container the nurse or physician merely rotates the jacking ring counterclockwise. As the jacking ring 22 is rotated counterclockwise the left-handed threads 21 cause it to move downwardly a slight distance. This downward motion is not readily felt by the nurse or physician opening the bottle. To them it is a simple standard motion that they are quite accustomed to in unscrewing caps from bottles.

Figure 4:
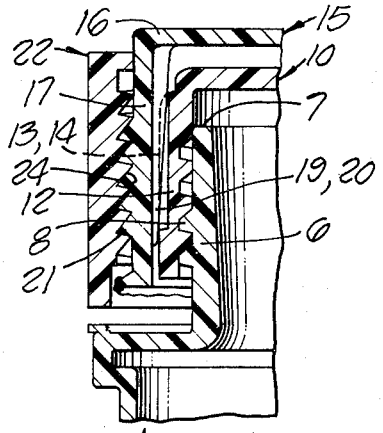
FIG. 4 is an enlarged sectional view of the left side portion of the closure system of FIG. 1 showing it in the process of being opened.

The sequence of steps happening internally of the double closure system as it is rotated counterclockwise is very important. As the jacking ring rotates counterclockwise it moves downwardly to exert a pressure on the frangible brim 18 that is fused to flange 9. This causes skirt 17 of the outer cap to be pullsed upwardly until frangible brim 18 is ruptured. As the jacking ring is screwed down tighter and tighter against brim 18 it is simultaneously wedging more tightly against the outer cap. This wedging takes place between a non-threaded flange portion at a top of the jacking ring. This can be seen in FIGS. 3 and 4. In FIG. 4 the jacking ring and outer cap are wedged at a contact point between numeral 22 and numeral 16. There is also a wedging action between the jacking ring and outer cap caused by the fractured portion of the frangible brim wedging against a lower portion of the jacking ring as shown in FIG. 4. The purpose of these two wedging actions at the top and bottom portion of the jacking ring is to prevent further counterclockwise rotation of the jacking ring relative to the outer cap after the brim has been fractured. A wedging action can also be created by terminating the threads of the jacking ring short of its top end, so the jacking ring and outer cap wedge when the upper end of these threads are reached by the outer cap threads.

When the brim 18 has been fractured continued counterclockwise rotation of the jacking ring simultaneously rotates the outer cap and the inner cap. Thus the jacking ring outer and inner caps are removed as a unit. The inner cap will preferably fit tightly enough in the outer cap so that the weight of the inner cap will not cause it to fall out of the outer cap. Therefore, the three part unit can be unscrewed and feels as a single cap to the nurse or physician.

This double screw closure system, with the left and right-handed threads, and the intersplining between the two caps, needs only a single counterclockwise motion to open the inner and outer hermetic seals. FIGS. 5 to 8 illustrate the steps in opening this double screw closure system. FIG. 5 shows the jacking nut as it is received at the hospital and is stored. Preferably the jacking nut has a slight space between jacking ring 22 and flange 9. This is so the jacking ring will not place undue stress on the frangible brim of the outer cap that is sealed to flange 9. To open the double closure system of this invention the jacking ring is rotated counterclockwise as in FIG. 5 to move it downwardly into contact with the flange 9. The jacking ring 22 is further rotated as in FIG. 6 to fracture the outer cap at its frangible brim 18. After fracture, the inner and outer caps and the jacking ring are simultaneously removed in a continuation of the counterclockwise rotation of the cap system. Once removed, the liquid contents from the container can be simply poured out as in FIG. 8.

The closure system and bottle of this invention work exceptionally well if the bottle is made of a polyallomer such as a propylene-ethylene copolymer thermoplastic material and the outer cap is likewise of the same propylene-ethylene copolymer thermoplastic material fused to this bottle. Eastman Chemical Company markets such a polyallomer under the name of TENITE. The inner cap and the outer jacking ring can be made of suitable rigid thermoplastic material.

In the foregoing specification and drawings a specific example has been used to illustrate the invention. However, it is understood by those skilled in the art that certain modifications can be made to this embodiment without departing from the spirit and scope of the invention.

We claim:

1. A method of opening a double closure cap system that includes a threaded inner cap screwed onto a container, and an outer cap that has left-handed threads, said outer cap being fused to the container and an annular jacking ring internally threaded with left-handed threads screwed onto said outer cap, comprising the steps of: rotating the jacking ring in a counterclockwise direction until the jacking ring contacts an abutting surface of the outer cap and container combination; rotating the jacking ring in a further counterclockwise movement for fracturing the outer cap; and simultaneously removing the inner and outer caps through still further counterclockwise rotation of the jacking ring.

2. The method as set forth in claim 1, wherein the container has a dispensing neck with right-handed threads which threadingly receives the inner closure, and the method further includes spirally removing a unit formed of the jacking ring, outer cap and inner cap upwardly along the dispensing neck threads to be removed therefrom as a single manipulable unit.

3. A method of opening a thermoplastic bottle with a threaded outlet neck hermetically sealed by a double closure system that includes a threaded inner cap screwed unto the bottle neck and a thermoplastic outer cap that encases the inner cap and has a section fused to the bottle, and between these two caps are interfering rotational stops, which method includes the steps of:

a. assembling an internally threaded jacking ring to the external threads of the outer cap, b. tightening the jacking ring on the external cap threads until the jacking ring contacts an abutment portion of the outer cap and bottle combination, c. slidingly engaging this abutment portion while further tightening said jacking ring on the outer cap causing this outer cap to fracture, d. rotating the combined jacking ring and fractured outer cap until rotational stops of the two caps contact; and e. continuing to rotate the jacking ring to transmit an opening torque through the fractured outer cap and rotational stops to the inner cap and thereby unscrew the inner cap from the bottle neck.

4. The method as set forth in claim 3, wherein all steps of this method are carried out by rotating the jacking ring in a single direction.

5. The method as set forth in claim 3, wherein the jacking ring wedges onto the outer cap when fracturing the outer cap, so the jacking ring and fractured outer cap function as a unit in transmitting torque to the inner cap.

6. The method as set forth in claim 5, wherein the method includes the further step of separating the unit of the jacking ring and fractured outer cap from the inner cap, whereby the inner cap can reclose the threaded bottle neck.

* * * * *